US005392933A

United States Patent [19]

Crosbie

[11] Patent Number: 5,392,933

[45] Date of Patent: Feb. 28, 1995

[54] RETRACTABLE CLOTHES LINE

[76] Inventor: Patrick J. Crosbie, Naspeth Post Office, 69th St., Naspeth, N.Y. 11378

[21] Appl. No.: 119,752

[22] Filed: Sep. 13, 1993

[51] Int. Cl.[6] ..... A47F 5/00
[52] U.S. Cl. ..... 211/119.05
[58] Field of Search ..... 211/119.05

[56] References Cited

U.S. PATENT DOCUMENTS

| | | | |
|---|---|---|---|
| 1,181,501 | 5/1916 | Bouton | 211/119.05 |
| 2,392,566 | 1/1946 | Avotzky | 211/119.05 |
| 2,444,879 | 7/1948 | Petersen | 211/119.05 |
| 2,943,746 | 7/1960 | Jacobsen | 211/119.05 |

*Primary Examiner*—Robert W. Gibson, Jr.
*Attorney, Agent, or Firm*—Nathaniel Altman

[57] ABSTRACT

A retractable clothesline device is mounted on a support outside a window with two pairs of pulleys supporting an endless clothesline formed into two parallel loops by the pulleys. The outer loop may be retracted through the window by a controlling slide wand for safe indoor laundry loading and unloading, by drawing stored clothesline from the inner auxiliary clothesline loop. Pushing the slide wand outwardly reverses the process, diminishing the outer primary clothesline loop and increasing the auxiliary reservoir loop, placing the device in its outdoor drying or not-in-use position, the clothesline being kept uniformly taut at all times.

7 Claims, 2 Drawing Sheets

BW
W
20
18
4
1
10
11
12
13
9
3
6
2
8
8a
5
17
14
16

RETRACTABLE CLOTHES LINE

FIELD OF THE INVENTION

This invention relates to clotheslines for drying laundry; more specifically, it relates to an outdoor clothesline mounted so that it may be retracted through a window of a dwelling for hanging or removing laundry therefrom, and may be extended again to a position outside the window for drying the wash or for storage of the clothesline when not in use.

BACKGROUND OF THE INVENTION

Conventional outdoor clotheslines located outside windows are awkward, cumbersome and rather hazardous, the user being forced to lean out the window to hang or remove laundry. The present invention has as its principal object the elimination of this situation by providing a device for the retraction of a portion of the clothesline through and inside to permit easy, comfortable, safe laundry loading or unloading. Other objects of this invention are to provide a retractable clothesline device which is uncomplicated to install and operate, is built sturdily to function effectively and efficiently through prolonged use, and can be produced inexpensively.

SUMMARY OF THE INVENTION

The clothesline device of this invention comprises a continuous clothesline rope extending around two pairs of pulleys, each pair having one fixed and one movable pulley, the clothesline forming a primary outer loop on which laundry may be hung, and a parallel inner auxiliary loop which serves as a reservoir for a predetermined portion of the clothesline. This reserve portion, when the device is operated, is fed automatically to the outer primary loop to permit its retraction through a window for safe indoor loading of laundry thereon. A horizontally disposed support crossbar, adjustably secured to the building wall outside and across the window, carries a horizontal sleeve, pivotally and adjustably mounted for alignment of the clothesline device. The sleeve supports a slide wand to be moved by hand therethrough in a horizontal reciprocating manner to operate the device. The movable pulley for the primary outer clothesline loop is mounted near the inner end of the slide wand; its paired stationary pulley is held rotatably on a conventional clothes pole or the like positioned at a suitable distance from the window. The movable pulley of the inner auxiliary clothesline loop is secured to the outer end of the slide wand, while its fixed counterpart is molted near the outer end of the sleeve. When the slide wand is retracted inwardly through the window manually for loading or unloading the clothesline, the outer loop expands and lengthens while the auxiliary loop is reduced by an equal amount; on pushing the slide wand outwardly to its drying or not-in-use position outside the window, exactly the reverse occurs, while the tautness of, and tension on, the clothesline is balanced by the freely rotating pulleys and remains unchanged throughout the operation of the device.

These and other details of this invention will be more fully described in connection with the accompanying illustrative but not limiting drawings, wherein:

SHORT FIGURE DESCRIPTION OF DRAWINGS

DESCRIPTION OF THE PREFERRED EMBODIMENTS

Figures 1, 2:
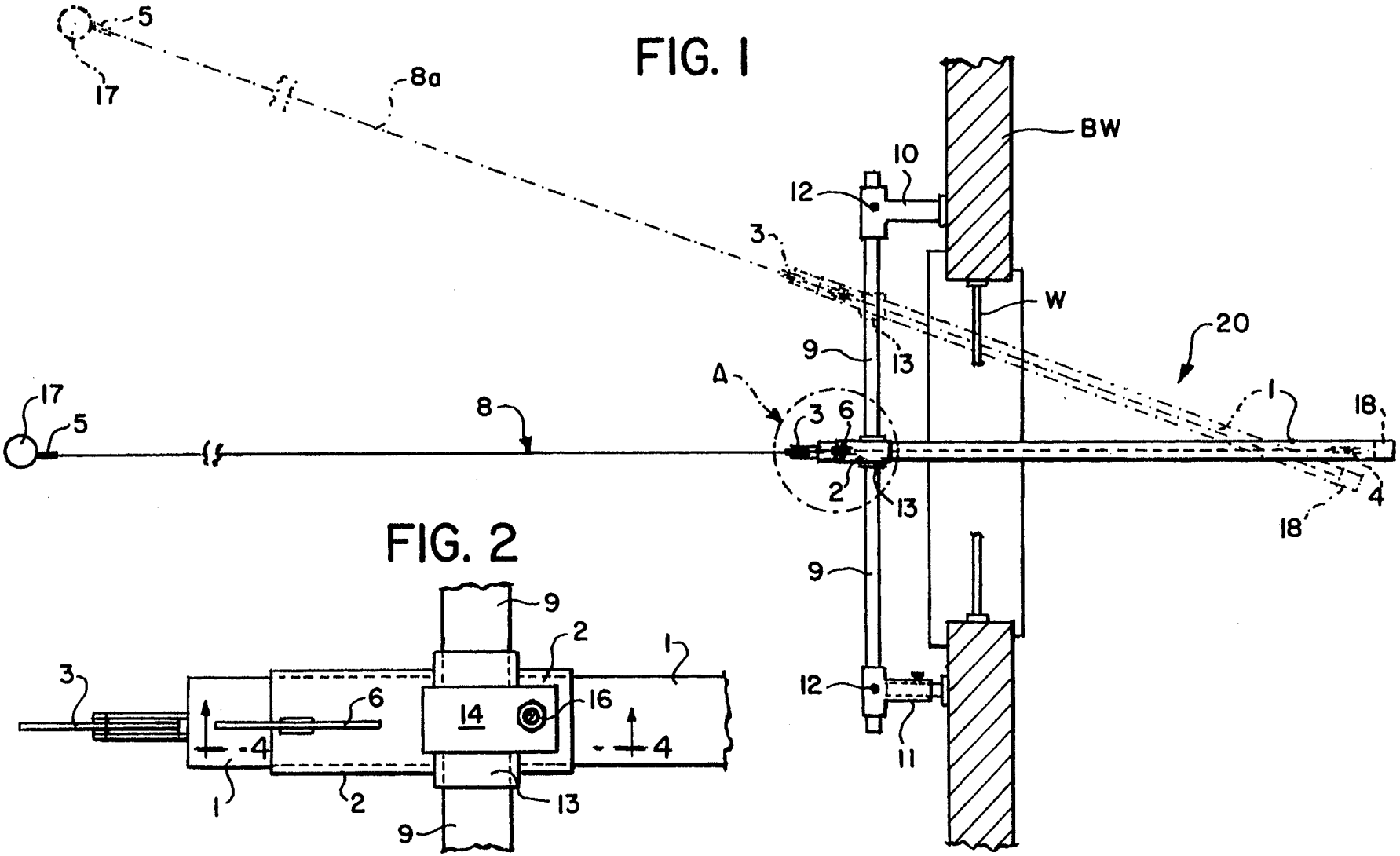
FIG. 1 is a plan view of a preferred embodiment of the retractable clothesline device of this invention, with the building wall and window shown in section for clarity.
FIG. 2 is an enlarged plan view detail of the encircled area A of FIG. 1.

Retractable clothesline device 20 is operated by slide wand or shaft 1, which is retained slidably for horizontal linear reciprocating motion in adjustably mounted sleeve 2. Both wand 1 and sleeve 2 are rectangular in cross-section and strong enough to provide stability and undistorted operation of device 20. Pulleys 3, 4, 5 and 6, best seen in FIG. 3, have continuous clothesline rope 8 trained around them to form both primary outer loop 8*a*, on which laundry such as clothing 7 may be hung in the conventional manner, and parallel inner auxiliary loop 8*b*, serving as a reservoir for a predetermined portion of clothesline rope 8 to be added to, or withdrawn from, primary loop 8*a* in the retraction or extension of clothesline 8.

Figure 4:
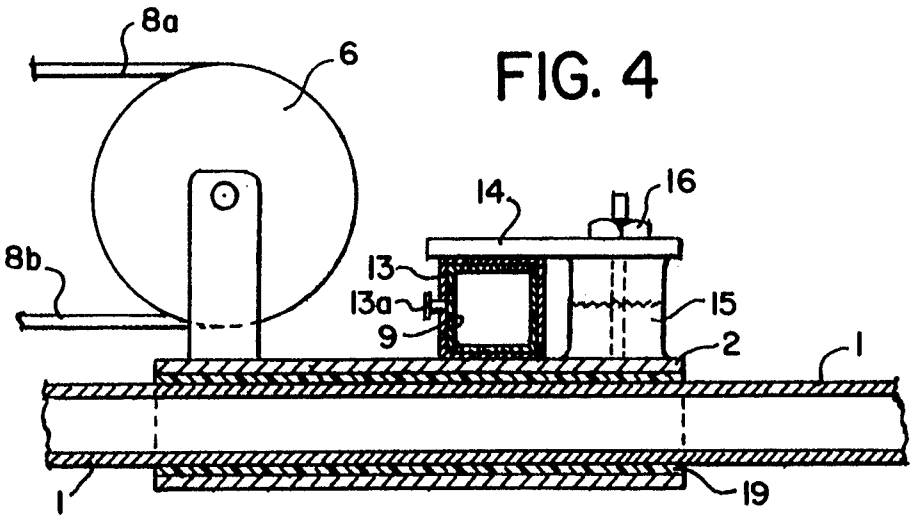
FIG. 4 is an enlarged sectional view taken along line 4—4 of FIG. 2.

As seen in FIG. 1, support for device 20 is provided by horizontally disposed rectangular crossbar 9, shown fixedly mounted, on building wall BW across and outside window W, by sleeve brackets 10 and 11, crossbar 9 being held therein by set screws 12. Bracket 11 is shown telescopically adjustable to compensate for any variation or irregularity in wall BW. Optionally, brackets 10 and 11 may be secured to the frame of window W rather than on wall BW. Collar 13 is carried by crossbar 9 in slidably adjustable fashion and fixed in place thereon by set screw 13*a*. Support plate it is secured to collar 13 and in turn carries the upper section of pivot mechanism 15, the lower section of which is fixed on sleeve 2, with this assembly held in place by nut 16 (see FIG. 4). Thus, the initial installation of device 20 requires positioning of sleeve 2 along crossbar 9 and adjusting its angular direction, using elements 13–16, to align sleeve 2, and consequently all of device 20, with existing clothes pole 17 or its equivalent (see angular position of device 20 shown in dashed lines in FIG. 1). This alignment ensures smooth operation of device 20, free rotation of pulleys 3–6, and uniformly taut clothesline 8 at all times.

Figure 3:
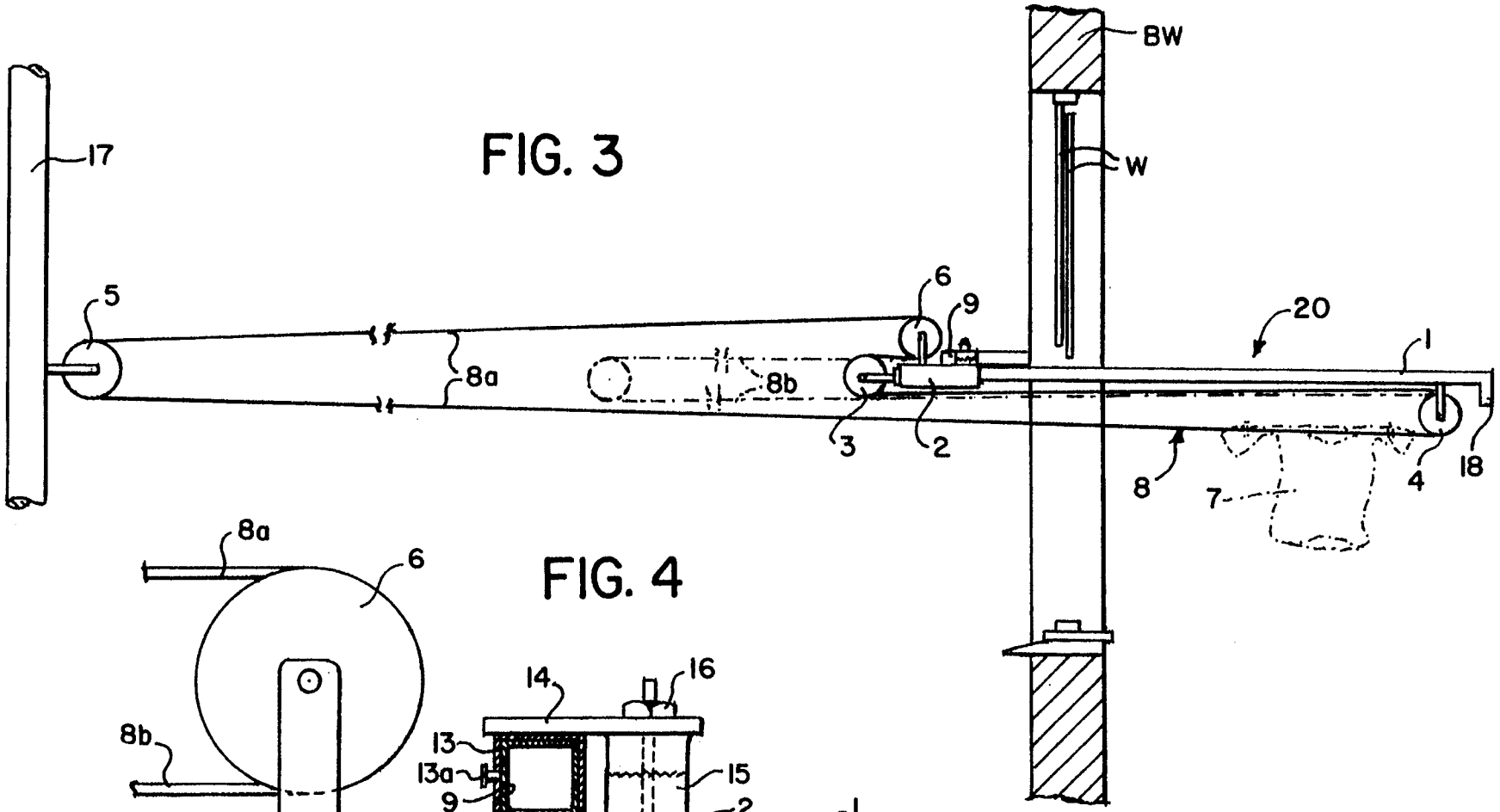
FIG. 3 is a side elevational view of the device of FIG. 1, with the building wall and window shown in section for clarity.

FIG. 3 illustrates the mountings, interrelationships and movements of pulleys 3–6. Pulley 4 is mounted near the inner end of slide wand 1, and moves with it; endless clothesline rope 8 extends therefrom to and around pulley 5, fixedly mounted for rotation on clothesline pole 17, this portion of clothesline 8 constituting outer primary clothesline loop 8*a*, which continues until it reaches pulley 6, mounted for rotation fixedly on sleeve 2. From pulley 6, rope 8 proceeds around pulley 3, mounted for rotation on the outer end of slide wand 1, rope 8 forming thereby parallel inner auxiliary loop 8*b* and completing its continuous loop back around pulley 4.

To operate device 20, it is a simple matter to move slide wand 1 manually by pulling inwardly on handle 18 depending from the inner end of wand 1 to the inmost position shown in FIGS. 1–3. In this position, as best seen in FIG. 3, laundry such as garment 7 may be comfortably and safely pinned on clothesline 8, which may then be moved by hand to load other laundry thereon. At this point, clothesline primary loop 8*a* is at its maximum length, with loop 8*b* at its shortest. Once all the laundry is hung, pushing against handle 18 of wand 1 causes pulleys 3 and 4 to be moved outwardly with wand 1, until the entire device 20 is outside window W, which may then be closed. Now, pulley 4 is just outside window W, pulley 3 has assumed its extended position (shown in dash lines in FIG. 3), loop 8*a* is at its shortest, and loop 8*b* has been enlarged, holding a predetermined length of clothesline 8 in stored reserve. Uniform tension or tautness in clothesline 8 is maintained throughout all the manipulations of device 20 by the balancing and compensating action of the pulley system.

When the laundry has dried, handle 18 may be pulled inwardly through opened window W back to its retracted indoor position for laundry removal, then pushed outwardly again to return slide wand 1 and device 20 to their external extended not-in-use location. The ease and smoothness of moving slide wand 1 in its horizontal linear reciprocating path through sleeve 2 is markedly enhanced by nylon bushing 19 lining the interior rectangular opening of sleeve 2 and minimizing any friction.

Slide wand 1's rectangular cross-section and metallic construction has been engineered to provide rigidity and firmness, and to withstand eighty-five pounds of weight at a four-foot span without deflection, and without further support than that described above. This has been calculated to be the maximum downward stress on pulley 4, and hence on slide wand 1, of a full clothesline of wet clothes with device 20 in its fully retracted position for loading.

The retractable clothesline device 20 has been fully described, and the best mode of practicing this invention now contemplated has been presented. Other embodiments, substitutions and modifications are contemplated and are considered to be within the concepts of this invention, limited only by the scope of the ensuing claims, wherein:

I claim:

1. Retractable clothesline device, comprising, in combination with outside anchoring means for the remote end thereof:

crossbar support means fixedly mounted horizontally across and outside the window of a dwelling;

sleeve support means adjustably mounted on said crossbar support means both for lateral positioning thereon as well as for angular positioning thereon, to align the retractable clothesline device with said outside anchoring means;

slide wand means rectangular in cross-section and slidingly retained in said sleeve support means for horizontal linear reciprocating motion thereof, the inner end of said slide wand to be retracted inside said window and to be extended outside said window manually;

multiple pulley means individually mounted for aligned rotation variously near said inner end of said slide wand, on said outside anchor means, on said sleeve support means and on the outer end of said slide wand: and a continuous endless clothesline rope extending tautly around said multiple pulley means to form an outer primary loop, on which laundry may be hung, and a parallel inner auxiliary loop, said inner loop serving as a reservoir for a predetermined portion of said continuous clothesline, whereby, when said slide wand is retracted by pulling it through said opened window for safe convenient loading on, or unloading off, said clothesline of laundry, said primary loop being automatically elongated and said auxiliary loop being depleted thereby, whereas, when said slide wand is pushed to its external extended position, the retractable clothesline device is completely outside the window in position for clothes-drying and not-in-use storage, said primary loop is diminished, said predetermined portion thereof having been restored automatically to said auxiliary reservoir loop, said clothesline remaining at substantially the same tension throughout the manipulations of the retractable clothesline device.

2. Retractable clothesline device as defined in claim 1, wherein said outdoor anchoring means is a conventional clothesline pole.

3. Retractable clothesline device as defined in claim 1, wherein said crossbar support means comprises a rigid crossbar member of rectangular cross-section, each end of said crossbar being held fixedly within a sleeve bracket by a set screw, said sleeve brackets having extensions mounted fixedly on an area selected from the group consisting of: the outer wall of said dwelling and the frame of said dwelling window, at least one of said sleeve brackets having said extension adjustable in length.

4. Retractable clothesline device as defined in claim 3, wherein said mounting of said sleeve support means comprises a collar having an opening therein rectangular in cross-section and dimensioned to accommodate fittingly said crossbar for sliding lateral adjustment thereon of said collar, said collar being suspended fixedly from one end of a support plate, the other end of said support plate being mounted rotatably on pivot means, the base of said pivot means being secured to the top surface of the inner end of, and suspendingly supporting, said sleeve support means as well as said slide wand means held therein, whereby rotation of said lower portion of said pivot means fixed to said sleeve support means may be used to adjust the angular positioning of said sleeve support means and said slide wand means relative to said crossbar support means to align them, and said pulley means mounted for rotation thereon, to point directly to said outdoor anchoring means.

5. Retractable clothesline device as defined in claim 1, wherein said sleeve support means further comprises a nylon bushing covering the interior surface of the rectangular opening in said sleeve support means, said opening accommodating said slide wand, said bushing providing lateral reciprocating movement of said slide wand therein with minimum friction being generated.

6. Retractable clothesline device as defined in claim 1, wherein said slide wand further comprises handle means positioned on its inmost end to facilitate the manually actuated linear reciprocating movement of said slide wand.

7. Retractable clothesline device as defined in claim 1, wherein said multiple pulley means comprises two pairs of nylon pulleys, said pulley mounted on said inner end of, and movable with, said sliding wand and said stationary pulley mounted on said outdoor anchoring means forming said first pair of pulleys and carrying said outer primary loop of said clothesline thereon, said second pair of pulleys comprising said stationary pulley mounted on said sleeve support means and said pulley mounted on said outer end of, and movable with, said slide wand and forming said inner auxiliary loop of said clothesline thereon.

* * * * *